US006552633B1

(12) United States Patent
Block et al.

(10) Patent No.: US 6,552,633 B1
(45) Date of Patent: Apr. 22, 2003

(54) CERAMIC MICROWAVE FILTER HAVING GREATER EDGE STEEPNESS

(75) Inventors: Christian Block, Stainz (AT); Bernhard Reichel, Deutschlandsberg (AT)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 09/664,000

(22) Filed: Sep. 18, 2000

Related U.S. Application Data

(63) Continuation of application No. PCT/DE99/00405, filed on Feb. 12, 1999.

(51) Int. Cl.[7] ..... H01P 1/205
(52) U.S. Cl. ..... 333/202; 333/206
(58) Field of Search ..... 333/206, 202, 333/202 DB

(56) References Cited

U.S. PATENT DOCUMENTS 5,124,676 A * 6/1992 Ueno ..... 333/206
5,327,108 A 7/1994 Hoang et al. ..... 333/203
5,808,526 A * 9/1998 Kaegebein ..... 333/202
5,945,896 A * 8/1999 Miyamoto ..... 333/206
5,986,521 A * 11/1999 Tada et al. ..... 333/206 X

FOREIGN PATENT DOCUMENTS

EP 0809315 A1 11/1997

OTHER PUBLICATIONS

Published International Application No. 93/24968 (Agahi–Kesheh et al.), dated Dec. 9, 1993.

* cited by examiner

*Primary Examiner*—Benny Lee
(74) *Attorney, Agent, or Firm*—Laurence A. Greenberg; Werner H. Stemer; Gregory L. Maybak

(57) ABSTRACT

The invention relates to a ceramic microwave filter having an insertion loss characteristic curve with an improved steepness. At least two resonators are provided in a one-piece ceramic body and coupling structures are assigned to the resonators for capacitively coupling the ceramic filter to an external RF circuit. At least one counter-oscillator is led in parallel with the resonators in the ceramic body.

7 Claims, 2 Drawing Sheets

CERAMIC MICROWAVE FILTER HAVING GREATER EDGE STEEPNESS

CROSS-REFERENCE TO RELATED APPLICATION

This is a continuation of copending international application PCT/DE99/00405, filed Feb. 12, 1999, which designated the United States.

BACKGROUND OF THE INVENTION

Field of the Invention

The present invention relates to a ceramic microwave filter having improved edge steepness, which has at least two resonators in a one-piece ceramic body and coupling structures associated with the resonators, for capacitively coupling the ceramic filter to an external radio-frequency circuit.

DE 197 41 147 A1 describes a ceramic microwave filter comprising a ceramic body in which two mutually parallel inner conductor bores with a round cross section are constructed as resonators. The ceramic body itself comprises two sintered green compacts pressed together, and is therefore seen to that extent as being one piece although the two green compacts form different dielectrics. The ceramic body also has coupling structures which are formed by electrical isolation of the metallic coating which is otherwise applied over the whole surface to the ceramic body. This isolation can be undertaken mechanically or by an etching technique or photo-resist technique.

Furthermore, DE 197 41 177 A1 describes a ceramic microwave filter which is formed from a standard ceramic body having coupling structures constructed on its surface and two inner conductor bores with a circular cross section as resonators, these two inner conductor bores having steps which serve to steepen the flanks of the forward characteristic of the ceramic microwave filter. The ceramic body of this ceramic microwave filter is also metallized on all sides with the inclusion of the inner surfaces of the inner conductor bores, the coupling structures being electrically isolated from this metal coating. Such ceramic microwave filters are preferably used as mobile radio filters in mobile radio telephones (mobiles).

Mobile radio sets and, specifically, mobile radio telephones are intended to have as high an output power as possible in order to be able to ensure a maximum output power in mobile radio sets, transmitting filters should be distinguished by insertion losses that are as low as possible, on the one hand, and transmission noise in a receiving band should be minimized by transmitting filters with a high selectivity, on the other hand. Thus, overall there is a need for a transmitting filter which has a high selectivity in conjunction with low insertion losses.

In the case of ceramic microwave filters, there is a fundamental relationship between insertion loss or the quality of the filter and the volume of the ceramic body of the filter. The larger the ceramic body made from a highly dielectric ceramic, the lower the insertion loss, since the quality of the line resonators coupled in the ceramic body is proportional to the volume of the ceramic body. This means that a reduction in the insertion loss can be achieved only via an increase in the volume of the ceramic body. However, this is opposed by the requirement that the ceramic microwave filters should be fashioned as small as possible for the purposes of mobile radio, in order likewise to be able to fashion the size of a mobile radio telephone to be as small as possible. It is to be noted that the selectivity can be H achieved only by increasing the pole number or by a complicated coupling of the resonators of the ceramic microwave filters with coils and capacitors to form a band-stop filter.

SUMMARY OF THE INVENTION

It is accordingly an object of the invention to provide a ceramic microwave filter having improved edge steepness which is distinguished by a lower insertion loss at the band edge, and thus by a correspondingly high edge steepness.

With the foregoing and other objects in view there is provided, in accordance with the invention, a ceramic microwave filter having a characteristic curve with an improved edge steepness. The ceramic microwave filter includes a one-piece ceramic body with at least two resonators and with coupling structures associated with the resonators for capacitively coupling the ceramic filter to an external RF circuit. At least one counter-oscillator is configured in the ceramic body approximately in parallel with the resonators.

If appropriate, it is also possible to provide two or more counter-oscillators, it being preferred for each resonator to be assigned a counter-oscillator. The resonators themselves can be rectangular in cross section, since given such a cross section, the unloaded quality, and thus the insertion loss of the ceramic microwave filter, can be further improved.

The ceramic body is completely metallized except for its raised end face, the coupling structures being isolated in the usual way from this metallic coating.

The two resonators which, as explained, preferably have a rectangular cross section, are excited capacitively via the coupling structures. The counter-oscillators are weakly excited, in order to render the insertion loss of the frequency at which the "counter-notch" forms in the characteristic curve as highly selective as possible. Specifically, at the same time the insertion loss at the band edge is then low, with the result that the edge steepness is correspondingly high.

The edge steepness and selectivity can be further increased by use of a second counter-oscillator when the "counter-notch" is selected to be approximately the same for both resonators, Another possibility consists in providing the counter-oscillator such that both filter edges of the ceramic microwave filter are steepened.

It is also possible, in principle, to use more than two resonators, although the insertion loss then rises slightly. However, a further improvement in the edge steepness can also be achieved here by using appropriate counter-oscillators.

Other features which are considered as characteristic for the invention are set forth in the appended claims.

Although the invention is illustrated and described herein as embodied in a ceramic microwave filter having improved edge steepness, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
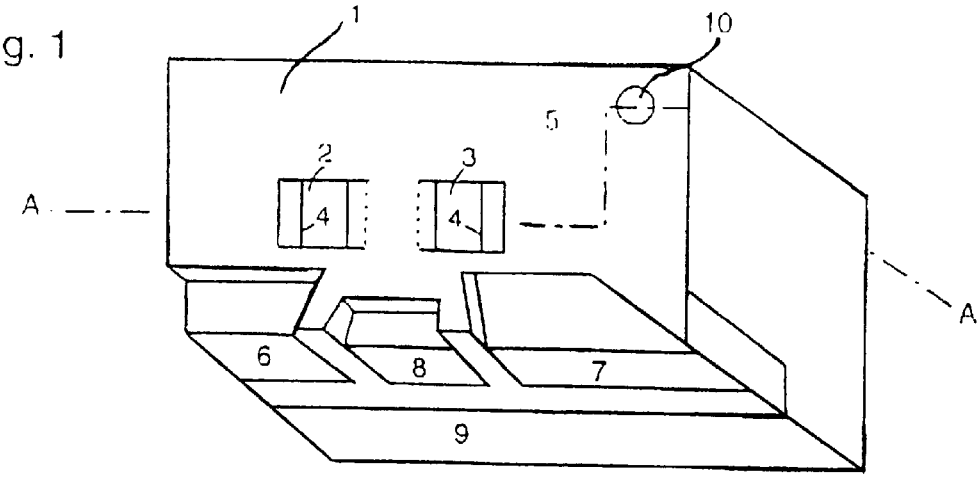
FIG. 1 shows a perspective illustration of a ceramic microwave filter in accordance with a first exemplary embodiment of the present invention.

Referring to the figures of the drawing in detail and first, particularly, to FIG. 1 thereof, there is shown a ceramic microwave filter in accordance with a first exemplary embodiment of the present invention. This ceramic microwave filter has a ceramic body 1 in which there are provided resonators 2, 3 which have a rectangular cross section for the purpose of improving the unloaded quality and thus the insertion loss, and also have steps 4 which steepen the edges of the forward characteristic of the ceramic microwave filter. The ceramic body 1 is completely metallized except for its end face 5, and metallization is also provided for the inner bores forming the resonators 2, 3. Coupling structures 6, 7 and ground or frame regions 8, 9 are, however, in this case isolated from the metallic coating which otherwise, with the exception of the raised end face 5, surrounds the ceramic body. The coupling structures 6, 7 can be electrically isolated from the ceramic body 1 either using a mechanical technique or by or using an etching technique or photo-resist technique.

The invention provides a counter-oscillator 10 which has a circular cross section.

Figure 2:
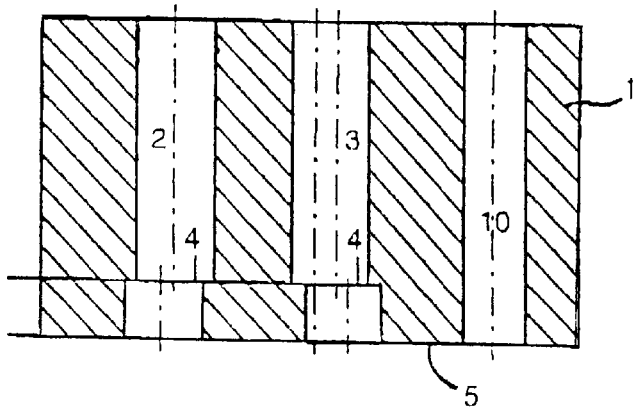
FIG. 2 shows a section A—A through the ceramic microwave filter of FIG. 1.

The two resonators 2, 3 are capacitively excited by the coupling structures 6, 7. The counter oscillator 10 is weakly excited to obtain a highly selective insertion loss at the frequency at which the corresponding counter-notch forms. Specifically, at the same time the insertion loss at the band edge is then low, with the result that the edge steepness is correspondingly high. FIG. 2 shows a section A—A through the ceramic microwave filter of FIG. 1.

Figure 4:
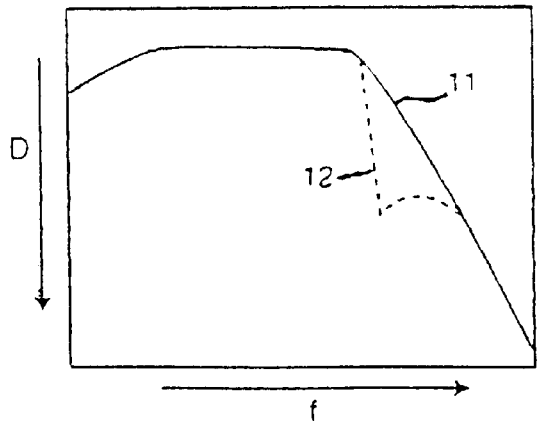
FIG. 4 shows the frequency-dependent loss characteristic in the case of a ceramic microwave filter with and without counter-oscillators.

The characteristic of the insertion loss D as a function of the frequency f is illustrated schematically in FIG. 4 for the ceramic microwave filter of FIGS. 1 and 2. A curve 11 shows the characteristic of a ceramic microwave filter without a counter-oscillator 10, while a curve 12 specifies the characteristic of the ceramic microwave filter according to the invention with the counter-oscillator 10. It is clearly to be seen that in the case of higher frequencies there is a greater steepness of characteristic, and thus a better selectivity. The insertion loss at the band edge is also lower overall than in the case of a ceramic microwave filter without a counter-oscillator 10.

Figure 3:
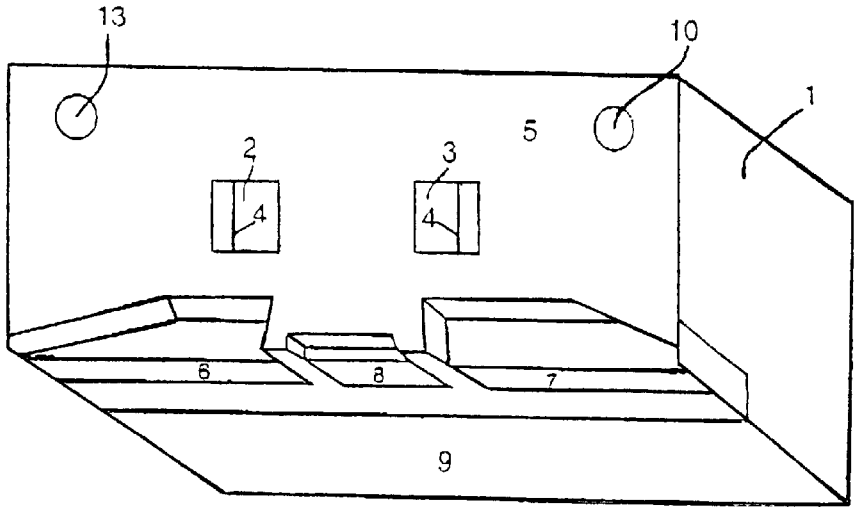
FIG. 3 shows a perspective illustration of a ceramic microwave filter in accordance with a further exemplary embodiment of the present invention.
Figure 5:
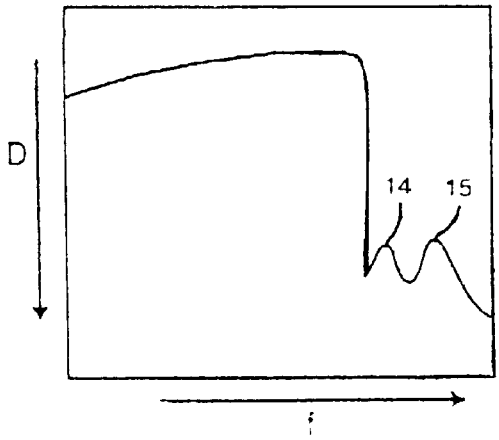
FIG. 5 shows the frequency-dependent loss characteristic in the case of a ceramic microwave filter according to the invention, in which two counter-oscillators are used, the counter-notch being selected to be approximately the same for both resonators.
Figure 6:
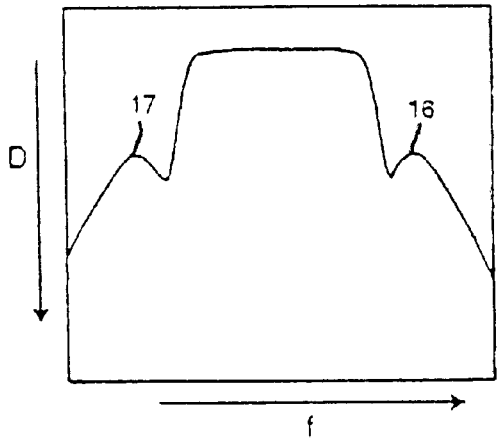
FIG. 6 shows the frequency-dependent loss characteristic in the case of a ceramic microwave filter in accordance with the present invention, in which both filter edges are steepened by using two counter-oscillators.

FIG. 3 shows a further exemplary embodiment of the ceramic microwave filter according to the invention, in which a second counter-oscillator 13 has been provided in addition to the counter-oscillator 10 of the first exemplary embodiment of FIG. 1, where like features in FIGS. 1 and 3 are designated by the same reference numbers. The edge steepness and selectivity can be further increased by means of these two counter-oscillators 13 when she counter-notch 14 or 15 (compare FIG. 5), respectively, of the two resonators 2, 3 is selected to be approximately the same, something which is achieved by an appropriate configuration and fashioning of the counter-oscillators 10, 13, However, the possibility also presents itself of employing appropriate fashioning and configuration of the counter-oscillators 10, 13 to select the counter-notch 16 or 17, respectively, such that both filter edges are steepened, as is shown in FIG. 6.

If appropriate, it is also possible to provide more than two resonators 2, 3. Although this does result in a slight rise in the insertion loss, the latter is compensated by the use of appropriate counter-oscillators, with the result that it is possible to achieve overall a further improvement in the edge steepness.

Typical dimensions for the resonators 2, 3 are, for example, side lengths of 1.2 mm, a square cross section being assumed, 8.16 mm for the length of the cuboid ceramic body 1, 4.5 mm for a depth thereof and 4.76 mm for the height thereof. The steps 4 can be configured at a depth of approximately 0.8 mm from the end face 5. The diameter of the counter-oscillators 10 and 13 with a circular cross section is approximately 0.9 mm.

However, of course, other dimensions are also possible and suitable at any time as well, and this depends on the respective application of the ceramic microwave filter.

Conventional ceramic materials can be used for the ceramic body 1 itself. It is also possible for the ceramic body 1 to be fashioned in one piece overall from two parts, for example.

We claim:

1. A ceramic microwave filter having a characteristic curve with an edge steepness, comprising:

a one-piece ceramic body having at least two resonators and coupling structures each associated with a respective one of said at least two resonators for capacitively coupling the ceramic filter to an external RF circuit, said ceramic body having an end piece and being metallized except for said end piece; and at least one counter-oscillator configured in said ceramic body approximate in parallel with said at leapt two resonators for providing a greater edge steepness in the characteristic curve, said at least one counter-oscillator being weakly excited.

2. The ceramic microwave filter according to claim 1, wherein said at least two resonators are two resonators and said at least one counter oscillator is two counter-oscillators.

3. The ceramic microwave filter according to claim 1, wherein said at least two resonators have a square cross section.

4. The ceramic microwave filter according to claim 1, wherein said at least two resonators have a rectangular cross section.

5. The ceramic microwave filter according to claim 1, wherein said at least one counter-oscillator has a circular cross section.

6. The ceramic microwave filter according to claim 1, wherein said at least one counter-oscillator is configured to deepen both edges of the filter characteristic curve.

7. A ceramic microwave filter having a characteristic curve with an edge steepness, comprising:

a one-piece ceramic body having at least two resonators and coupling structures each associated with a respective one of said at least two resonators for capacitively coupling the ceramic fitter to an external RF circuit; and at least one counter-oscillator configured in said ceramic body approximately in parallel with said at least two resonators for providing a greater edge steepness in the characteristic curve, said at least one counter-oscillator being weakly excited, and said at least one counter-oscillator being configured for causing a respective counter-notch for each of said at least two resonators to be approximately the same.

* * * * *

UNITED STATES PATENT AND TRADEMARK OFFICE

CERTIFICATE OF CORRECTION

PATENT NO. : 6,552,633 B1 
DATED : April 22, 2003
INVENTOR(S) : Christian Block et al.

It is certified that error appears in the above-identified patent and that said Letters Patent is hereby corrected as shown below:

Title page,
Item [30], should read as follows:
-- Mar. 18, 1998 (DE) …… 198 11 861.9 --

Signed and Sealed this

Nineteenth Day of August, 2003

JAMES E. ROGAN
*Director of the United States Patent and Trademark Office*